US009371208B2

(12) United States Patent
Herrmann

(10) Patent No.: US 9,371,208 B2
(45) Date of Patent: Jun. 21, 2016

(54) SYSTEMS AND METHODS FOR IMPLEMENTING AN AUGER-BASED TRANSPORT MECHANISM FOR VERTICAL TRANSPORT OF IMAGE RECEIVING MEDIA IN IMAGE FORMING SYSTEMS

(71) Applicant: XEROX Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 86 days.

(21) Appl. No.: 14/039,045

(22) Filed: Sep. 27, 2013

(65) Prior Publication Data

US 2015/0091248 A1 Apr. 2, 2015

(51) Int. Cl.

| | |
|---|---|
| ***B65H 31/24*** | (2006.01) |
| ***B65H 31/30*** | (2006.01) |
| ***B65H 33/16*** | (2006.01) |
| ***B65H 39/105*** | (2006.01) |
| ***B65H 29/42*** | (2006.01) |

(52) U.S. Cl.

CPC ..... *B65H 31/24* (2013.01); *B65H 29/42* (2013.01); *B65H 31/3063* (2013.01); *B65H 33/16* (2013.01); *B65H 39/105* (2013.01); *B65H 2301/4212* (2013.01); *B65H 2301/4213* (2013.01); *B65H 2301/44765* (2013.01); *B65H 2701/1822* (2013.01); *B65H 2801/06* (2013.01)

(58) Field of Classification Search

CPC .... B65H 31/24; B65H 31/30; B65H 31/3009; B65H 31/3018; B65H 31/3063; B65H 31/3054; B65H 33/06; B65H 33/16; B65H 39/10; B65H 39/105; B65H 29/38; B65H 29/40; B65H 29/42; B65H 2301/422; B65H 2301/4225; B65H 2301/4226; B65H 2301/422615; B65H 2301/42264; B65H 2301/44765; B65H 2301/4477; B65H 2404/66; B65H 2404/663; B65H 2404/67

See application file for complete search history.

(56) References Cited

U.S. PATENT DOCUMENTS

| | | | | |
|---|---|---|---|---|
| 4,547,114 | A * | 10/1985 | Watrous et al. | 414/793.9 |
| 5,429,349 | A * | 7/1995 | Supron et al. | 271/179 |
| 5,480,135 | A * | 1/1996 | Nagane et al. | 271/176 |
| 5,544,876 | A * | 8/1996 | Ruch | 271/179 |
| 5,562,399 | A * | 10/1996 | Schulz | 414/795 |
| 5,667,213 | A * | 9/1997 | Chida et al. | 270/58.03 |
| 5,816,570 | A * | 10/1998 | Paradis et al. | 271/179 |
| 6,644,661 | B2 * | 11/2003 | Ikeda | 271/279 |

(Continued)

*Primary Examiner* — Ernesto Suarez

(74) *Attorney, Agent, or Firm* — Ronald E. Prass, Jr.; Prass LLP

(57) ABSTRACT

A system and method are provided for implementing an auger-based transport device as a vertical compiler in an image forming system. The auger-based transport device includes a plurality of mechanical augers for vertical transport of image receiving media substrates, or sets of substrates in a controlled manner. The disclosed auger-type drive systems leverage comparatively simpler mechanical operations to provide a plurality of auger devices that simplify the motions and mechanisms of the component elements in a vertical transport path in a manner that maintains positive control of each set of image receiving media substrates in a manner that does not disturb the sets as they are lowered vertically, eliminating errors introduced by random dropping of substrates in conventional vertical image receiving media substrate handling mechanisms. The auger components are not particularly limited in number, in pitch (constant or variable), in diameter and/or in use/function.

7 Claims, 6 Drawing Sheets

(56) References Cited

U.S. PATENT DOCUMENTS 7,475,522 B2 * 1/2009 Ponti ..... 53/381.5

9,027,922 B2 * 5/2015 Stojanovski ..... B65H 29/42 271/177

* cited by examiner

SYSTEMS AND METHODS FOR IMPLEMENTING AN AUGER-BASED TRANSPORT MECHANISM FOR VERTICAL TRANSPORT OF IMAGE RECEIVING MEDIA IN IMAGE FORMING SYSTEMS

BACKGROUND

1. Field of Disclosed Subject Matter

This disclosure relates to systems and methods for implementing at least one auger-based transport device or system comprising a plurality of mechanical augers for vertical transport of image receiving media, such as, for example, transport of collated sets of image receiving media in post-processing systems of image forming devices and advanced image forming systems.

2. Related Art

Many modern, sometimes complex, image forming systems make use of myriad individual and interchangeable component devices. These include multiple different (1) image receiving media supply devices for supplying differing compositions of image receiving media substrates at an input end of the image forming system, (2) pre-processing and/or conditioning devices for preparing at least one surface of the image receiving media substrates to receive at least one marking material with which images will be formed on the at least one surface, (3) marking devices for depositing the at least one marking material on the conditioned surfaces of the image receiving media substrates to form the images according to input or read image signals, (4) fusing/finishing systems, primarily used for fixing the deposited at least one marking material on the image receiving media substrates to make the images formed on the image receiving media substrates less likely to damaged, e.g., more permanent, and (5) post-processing devices for accomplishing certain post processing tasks including collating the image receiving media substrates as sets comprising a multi-page finished document and stapling or otherwise binding the multi-page finished document.

The many and widely varied component devices may be individually arranged as image forming systems in a number of different configurations. The individual component devices are generally interconnected by a series of increasingly intricate image receiving media substrate transport systems, paths and/or components. The image receiving media transport systems, paths and/or components are generally designed and implemented to not limit the transport requirements from an output of one device to the input of another. This design flexibility can be beneficial as the transport paths remain generally supportive of the interchangeable components to which they are connected.

At an end of the processing scheme, the form and function of the image receiving media transport systems, paths and/or components often becomes more narrowly defined. The print job is generally completed with individual sheets of image receiving media, with the images formed and fixed thereon, being collected in sets at an output of one or more post-processing devices. Manipulation of the individual image receiving media sheets (substrates) or of the sets of image receiving media sheets (substrates) at that point in the processing of the documents responsive to the directed print job can be particularly intricate. There is often a need to ensure that the sets of image receiving media substrates are fairly precisely stacked in order to facilitate one or more finishing processes including, for example, stapling or binding.

The manipulations associated with aligning individual sheets into stacks are broadly referred to as, and are generally understood by those of skill in the art to involve, functions of stacking and tamping the individual sheets of image receiving media into precise alignment in the sets. Stacking often occurs against a static edge alignment body portion at an output of the post processing device to provide longitudinal alignment of the individual sheets of image receiving media in a process direction, stacking being generally a passive process. Tamping generally refers to an often active alignment component in which paddles or other devices may be employed on any, but most often, lateral sides of a set of image receiving media substrates to align the set in a direction orthogonal to the process direction.

Certain currently-fielded systems may be configured with what may generally be described as vertical compiler (stacker) setups. FIG. 1 illustrates a simple schematic representation of a side view of an exemplary system 100 incorporating a commonly-implemented vertical compiler setup. FIG. 2 illustrates a simple schematic representation of a top plan view of an exemplary system 100 incorporating the same commonly-implemented vertical compiler setup. As shown in FIGS. 1 and 2, individual sheets of image receiving media substrates 130 exit an imaging system processing/post-processing device 110 at an exit/ejection port 115 and are individually deposited in an output tray 120.

A "bottom" or platform of the output tray 120 may consist of a plurality of longitudinally-arranged image receiving media substrate supports that extend in a process (longitudinal) direction of the image receiving media substrate 130. The image receiving media substrate 130 rests on the substrate supports and is generally manually recoverable from the substrate supports.

In exemplary systems such as that shown in FIGS. 1 and 2, vertical set compilation may occur in one or more stages as follows. Individual image receiving medium substrate(s) 130 may be dropped in stages from the output tray 120, acting as a temporary compiler. This dropping may be effected, by laterally-opposing motions (orthogonal to the process direction) of the plurality of longitudinal image receiving media substrate supports (or arms) toward opposed lateral edges of the output tray 120, displacing the substrate supports from under the image receiving media substrate 130. As a result of the linear movement of the plurality of longitudinal image receiving media substrate supports, each of the image receiving media substrates 130 drops down to an image receiving medium set receiving platform, or an output set collection platform component 150.

The image receiving media substrates 130 may be collected as a set 140 on the output set collection platform component 150. The output set collection platform component 150 may be, in turn, comprised of at least a pair of compiler shutters 152/154. Each sheet of image receiving media substrate 130 in the set is dropped in a similar fashion to create the set 140 of image receiving media on the compiler shutters 152/154. When the set of image receiving media 140 is complete and properly registered, and optionally, for example, bound or stapled, the set of image receiving media 140 is then dropped onto a stack of previously dropped sets of image receiving media 170, or directly onto some manner of set output transport path 160 to be moved in a process direction B from stack position 170 to stack position 180 and beyond.

The above-described dropping function is currently undertaken in commonly-implemented vertical compiler setups by rapid cycling of the compiler shutters 152/154 in opening and then closing in mechanically opposing motions.

Both of the above-described drop functions will often tend to introduce variation in set registration in the first individual sheet drop stage and the set-to-set (stack) registration in the second drop stage. This process, requiring automated cycling of the supports/arms and the shutters opening in a first mechanical motion, and closing in a second and opposite direction second mechanical motion, stresses the mechanical components of the shutters and shutter actuators. This process can generally only be accomplished with high acceleration motions in all of the affected physical mechanisms, i.e., the temporary compiler arms, shutters, side tampers, and movable trailing edge tampers. This process also pushes the limits of timing based on the inertia of, and required reversal in, the multiple mechanical components.

SUMMARY OF THE DISCLOSED EMBODIMENTS

Operating and processing speeds for completing intricate print jobs in complex image forming systems continue to increase. The demands for precision in registration and alignment of sets of documents remain very high. This combination of factors places ever increasing stress on conventional systems causing mechanical components to fail. Also, as reciprocating mechanical components, including compiler shutters, are caused to move at increased speeds, disturbances may be introduced that may adversely affect the efforts to precisely align the stacks of image receiving media substrates comprising each set. Abrupt movements of the shutters, for example, may cause the image receiving media substrates to be displaced slightly with the movement of the shutters. Additionally, rapid reciprocating movements may introduce airflows at relatively higher velocities that may cause the individual image receiving media substrates to be fluffed, fluttered and skewed in a random manner. These functional difficulties may increase demands placed on longitudinal (trailing edge) and lateral (side) tampers as these components are, in turn, called upon to routinely react more rapidly to correct increasingly frequent and extensive alignment errors.

It would be advantageous in view of the above-noted image receiving medium handling difficulties arising from increasingly high speed document preparation requirements and the significantly increased mechanical stresses placed on linearly reciprocating components to find some manner by which to optimize movement of vertically moved image receiving media substrates and stacks of image receiving media in a manner that reduces and/or slows overall movement, and particularly high speed reciprocating movement, of certain components in the vertically-configured image receiving media transport paths.

Exemplary embodiments of the systems and methods according to this disclosure may implement an auger-type drive system as at least one of the components of a vertical image receiving media transport path in a manner that achieves some of the above objectives in overcoming the identified shortfalls in conventional vertical compilers and transport mechanisms in image forming systems.

Exemplary embodiments may leverage comparatively simpler mechanical operations to provide a plurality of auger devices that simplify the motions and mechanisms of the component elements in the vertical transport path, maintain a more positive control of each of the stacks of image receiving media substrates in a manner that does not disturb the sets as they are lowered vertically, and substantially eliminate errors introduced by random dropping of image receiving media substrates on a stack in forming the sets, or in compiling multiple sets in a stack.

In embodiments, introduction of an auger to the processes of image receiving media substrate and set transport through an appropriately-configured vertical image receiving media transport path may simplify a design of the transport path by (1) slowing down the process and particularly the mechanical movements that are required of conventional linearly-reciprocating mechanical components, and (2) simplifying the functions and mechanisms of the individual component elements required to complete the registration and compiling of the sets and the stacks.

Exemplary embodiments may provide an auger-type structural and functional component that implements, by its very nature, a simpler, more controlled, rotary only motion to provide the a comparatively more controlled vertical movement of the substrates.

Exemplary embodiments may include auger components that are not particularly limited in number, in pitch (constant or variable), in diameter and/or in use/function.

Exemplary embodiments may result in particularly increased throughput of image receiving media substrates being compiled in sets and sets being collected in stacks by segmenting the vertical image receiving medium transport process. Such a configuration may shorten a distance traveled by the image receiving media substrate sheets and sets during subsequent moves processing leading to an output from the image forming system. By shortening the distances traveled, the mechanical motion of system components may be reduced with no decrease in overall system throughput with regard to finished documents from the image forming system.

Exemplary embodiments may implement an auger or augers within a given physical component footprint to allow for vertical movement of sequential sets onto the stack. The auger or augers may tend to provide a smooth transition from a linear transport section out of a finisher or other post-processing device in a process direction to being moved, in a controlled manner, vertically downward to be deposited on a stack.

Exemplary embodiments may eliminate random uncontrolled physical drops existing in current designs thereby improving in-set and set-to-set registration.

In exemplary embodiments, the disclosed auger system may provide a segregatable "container" for each set as it moves through the system for registration and stapling prior to stacking.

Exemplary embodiments may feed individual image receiving medium substrate sheets of a set into or onto a plurality of augers until a complete set is formed. In embodiments, the plurality of augers may then rotate at least a portion of a turn to move the set down one level while opening up a top of the auger section (comprising the plurality of augers) for the next incoming set. The first set may thus be placed in a buffer position where a second operation may be performed on the first set or even a portion of the second operation may be performed on the first set, even as a second set is being collected on a top of the augers. As each subsequent set is captured on the top of the augers, the lower sets may continue to be controllably moved vertically lower in the vertical compiler system. In embodiments, an operation could be performed at each of multiple levels as the sets are moved vertically lower in a mechanically controlled manner.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing an auger-based transport system comprising a plurality of mechanical augers for vertical transport of image receiving media at least in post-processing systems of image forming devices and advanced image forming systems will be described, in detail, with reference to the following drawings, in which.

DETAILED DESCRIPTION OF THE DISCLOSED EMBODIMENTS

Figure 1:
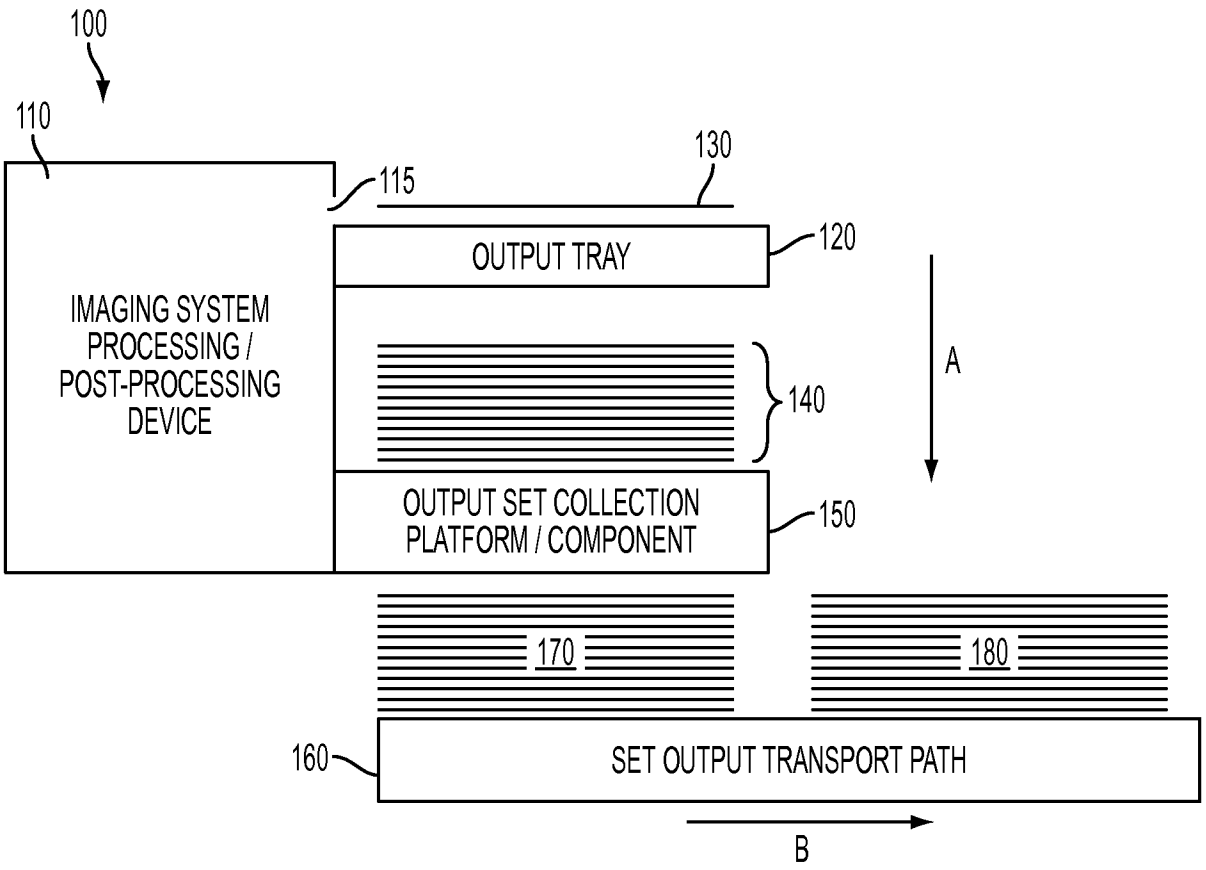
FIG. 1 RELATED ART
FIG. 1 illustrates a simple schematic representation of a side view of an exemplary related art system incorporating a commonly-implemented vertical compiler setup that may be improved upon using the systems and methods according to this disclosure.
Figure 2:
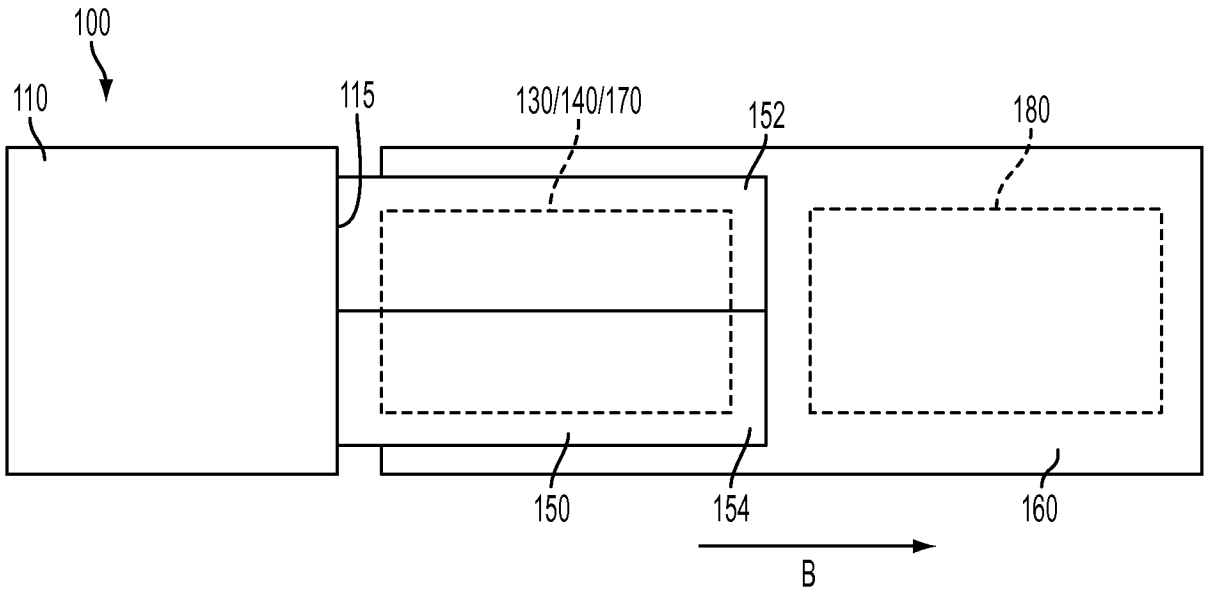
FIG. 2 RELATED ART
FIG. 2 illustrates a simple schematic representation of a top plan view of the exemplary related art system incorporating the same commonly-implemented vertical compiler setup shown in FIG. 1.

The systems and methods for implementing an auger-based transport system comprising a plurality of mechanical augers for vertical transport of image receiving media substrates at least in post-processing systems of image forming devices and advanced image forming systems according to this disclosure, will generally refer to this specific utility or function for those systems and methods. Exemplary embodiments described and depicted in this disclosure should not be interpreted as being specifically limited to any particular configuration of the described elements, or as being specifically directed to any particular intended use, including any particular functioning or operation of a processing, post-processing or other component device in an image forming system in which elements of the disclosed auger-based transport system or mechanical auger vertical compiler device may be advantageously employed.

The disclosed auger-based vertical compiler systems are not limited to any strict configuration of the individual mechanical auger devices, and should be read to encompass auger devices of any particular number, of any particular pitch (fixed or variable), of any particular size, and of any particular use/function. Any advantageous combination of schemes that may employ a particular auger-based structure or scheme for providing a controlled vertical movement of individual image receiving media substrate sheets, sets of image receiving media substrate sheets and stacks of sets, which may include subsequent post-processing prior to being output from an image forming system are contemplated as being encompassed by this disclosure.

Specific reference to, for example, various configurations of image forming systems and component devices within those systems, including post-processors, as those concepts and related terms are captured and used throughout this disclosure, should not be considered as limiting those concepts or terms to any particular configuration of the respective devices, the system configurations or individual elements. The subject matter of this disclosure is intended to broadly encompass systems, devices, schemes and elements that may involve image forming and finishing operations, as those operations would be familiar to those of skill in the art. The disclosed concepts are particularly adapted to providing one or more auger-based vertical compiler systems in appropriate image receiving media transport paths between individual component devices associated with image forming and finishing in a complex image forming system.

An objective of the disclosed systems and methods is to limit, or otherwise slow down, movement of certain mechanical components in the image receiving media transport paths in a manner that (1) extends the mechanical life of those components and (2) improves substrate-to-substrate (in-set) or set-to-set registration as sets and stacks are respectively compiled, while preserving or increasing an overall throughput of imaged substrates through a complex image forming system comprising multiple component devices for image marking and media post-processing, as those concepts are understood by those of skill in the imaging and image forming arts.

The disclosed schemes may particularly be directed at mitigating issues that arise in attempts to address increasing rates of image receiving media substrate throughput in post-processing devices while trying to limit mechanical wear on system components and improve stacking registration. An auger-based vertical movement system may provide a simple motion that will generally not disturb sets as they are compiled by controlling movement of the sets (eliminating random dropping) and by simplifying and slowing the motions and mechanisms (largely removing quickly reciprocating motions) required for compiling and stacking.

The disclosed systems and methods depart from conventional means and schemes in which paper is generally dropped from temporary compiler arms down to the compiler shutters, each sheet of the set being comparatively uncontrollably dropped in a similar fashion to create the set on the compiler shutters. When the set is complete and properly registered, and potentially stapled or otherwise bound, the set is then dropped onto a stack of previously-dropped sets. Both conventional drop functions may introduce variation to the in-set registration and the set-to-set registration. The conventional process, as described, is recognized by those of skill in the art to stress the limits of timing and overall substrate/set throughput by requiring high acceleration motions in all of the affected mechanisms—temporary compiler arms, shutters, and side and trailing edge tampers, in a mechanically stressful rapidly cycling reciprocating motion.

The disclosed systems and methods introduce a plurality of auger devices to the vertical transport and compiling process in manner that simplifies the design of the transport mechanisms. In embodiments, an auger-based approach is provided that first slows down the process, and second simplifies the mechanical structures by which the process is completed to provide the registration and compiling of the sets of sheets and the stacks of sets. An auger may provide a much simpler motion, i.e., rotary only, allowing the systems within which the disclosed compilers are incorporated to effectively increase throughput by, for example, segmenting the image receiving media transport process, thus shortening a particularly-segmented distance traveled by the sheets and sets during the subsequent (transport) moves.

By shortening the segmented distances traveled, the motion can be slower with no decrease in the overall throughput of the system. The augers can be implemented in the given footprint, which is understood to be a potential constraint for incorporating new vertical compiler components into current complex image forming systems and designs. The augers allow for the vertical movement of sets onto a stack in providing a smooth transition from, for example, an output transport section of a post-processing device, such as a finisher, to the stack. By eliminating the random uncontrolled drops that are present in the conventional designs, in-set and set-to-set registration will be improved. In essence, the disclosed auger-based vertical compiler systems may be viewed as providing, within a single set of mechanical devices, a container for each set as it moves through the system for registration, stapling and/or other post processing prior to stacking.

Figure 3:
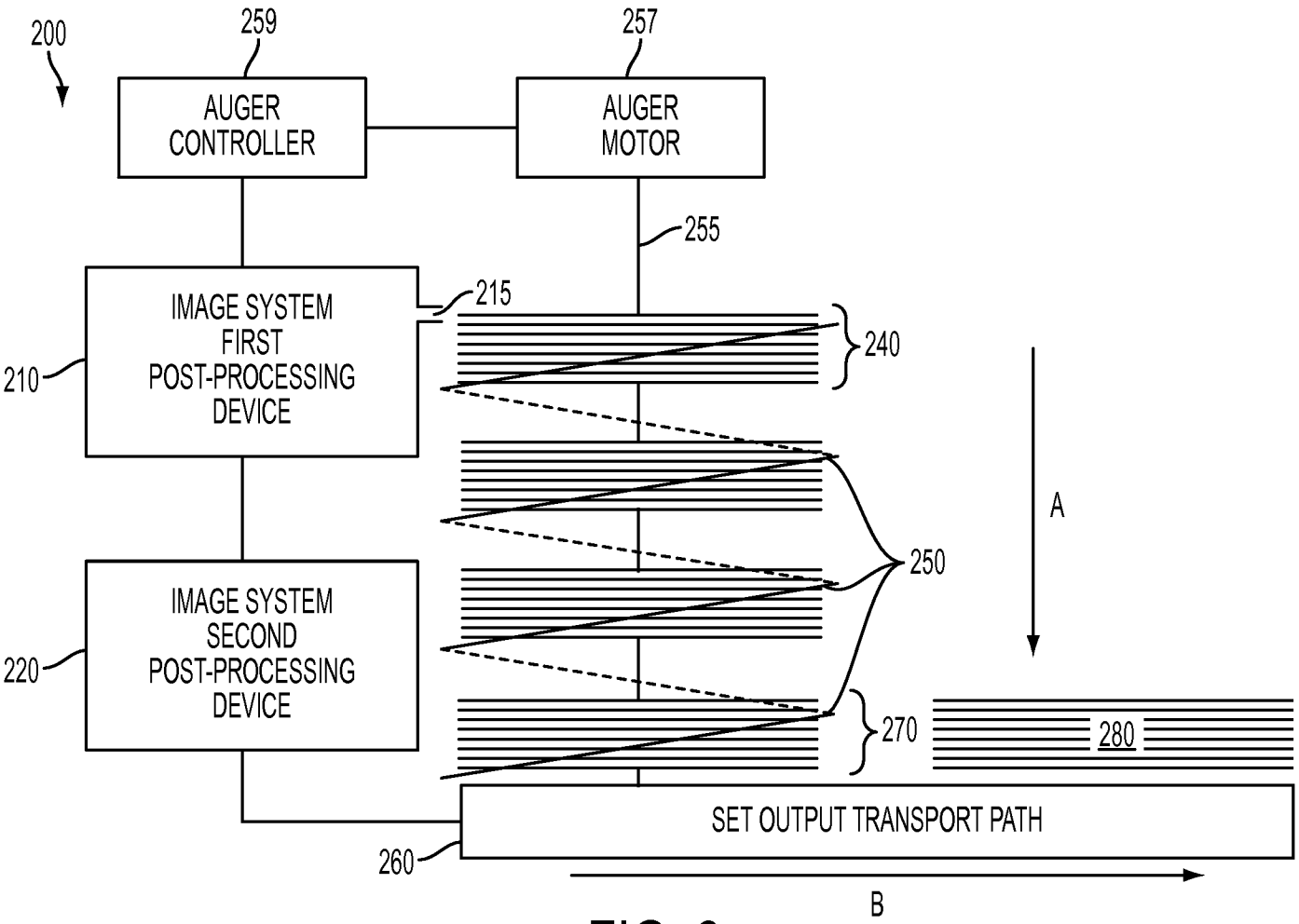
FIG. 3 illustrates a schematic diagram of a side view of an exemplary embodiment of a system incorporating an auger-based vertical compiler setup according to this disclosure.
Figure 4:
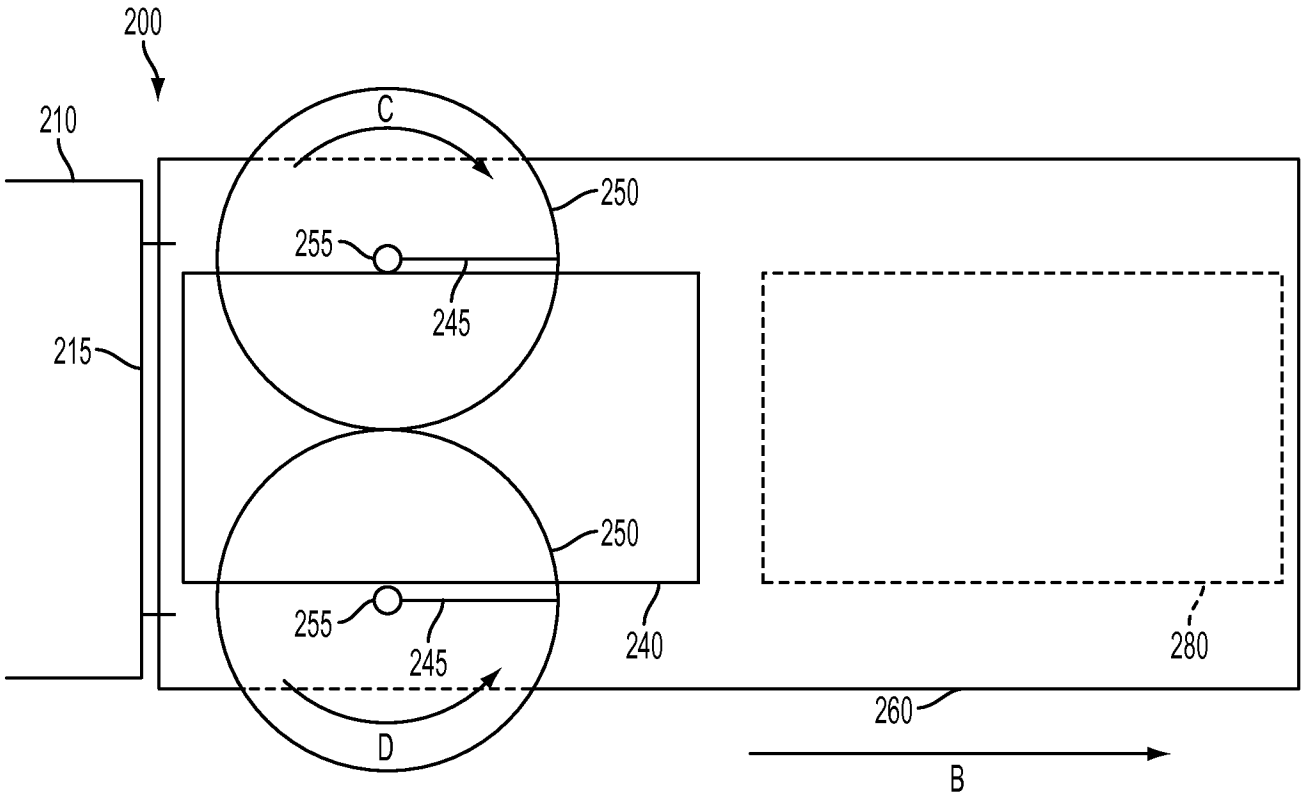
FIG. 4 illustrates a schematic diagram of a top plan view of the exemplary embodiment of the system shown in FIG. 3 incorporating the auger-based vertical compiler setup according to this disclosure.

FIG. 3 illustrates a schematic diagram of a side view of an exemplary embodiment of a system incorporating an auger-based vertical compiler setup according to this disclosure. FIG. 4 illustrates a schematic diagram of a top plan view of the exemplary embodiment of the system shown in FIG. 3 incorporating the auger-based vertical compiler setup according to this disclosure. As shown in FIGS. 3 and 4, individual sheets of image receiving media substrates exit an imaging system first post-processing device 210 at an exit/ejection port 215 and are individually deposited in top on an auger 250 for assembly as sets 240.

The augers 250 are then rotated about respective auger shafts 255 in a direction (preferably counter-rotating directions C-D) so as to cause the sets 240 to move vertically downward in direction A. The rotation of the augers 250 may be imparted by one or more auger motors 257 in mechanical communication with the auger shafts 255. Operation of the one or more auger motors 257 may, in turn, be controlled by an auger controller 259. The auger controller 259 may be a stand-alone component or may be a part or function of another processor of controller logic device in the image forming system. The auger controller 259 may receive input signals as a print job is processed in the image forming system to determine when and how much to rotate the augers 250 to complete the image forming process in the image system components with which the auger-based vertical compiler setup is associated.

A vertical profile for the pitch of the augers 250 not be particularly limited, and may be constant or variable over a direction parallel to the rotating axis of the auger. The vertical profile for the pitch may be configured to accommodate individual sets 240 up to a particular maximum number of sheets, and to provide a number of intermediate transport positions where an individual set may be temporarily stopped to be acted upon in part or in total by at least one second post-processing device 220. In other words, in the exemplary embodiment shown in FIGS. 3 and 4, vertical set compilation and processing may occur in one or more stages.

Individual image receiving medium substrate(s) may be collected on a top of the augers 250, acting as a temporary compiler. The image receiving media substrates may be collected as a set 240. When the set 240 of image receiving media substrates is complete and properly registered, it may be moved progressively down in a continuous or stepped motion. The set 240 may be presented, for example, to the second post-processing device 220 to be bound or stapled, or to have some other finishing operation performed on the set 240. The set 240 of image receiving media substrates may be moved in a controlled manner onto a stack of previously placed sets of image receiving media substrates, or directly onto some manner of set output transport path 260 to be moved in a process direction B from stack position 270 to stack position 280 and beyond to be output from the system.

The above-described vertical movement function undertaken by the methodical rotation of the augers 250 around vertical shafts 255 in directions C and D as a topmost opening edge 245 of the augers 250 is made to engage the set 240. The augers may turn in a same direction or in mutually counter-rotating directions C and D, as shown in FIG. 4. The augers 250 may preferably be rotated in a direction so that their inward motion, when in contact with the set 240, forces the set 240 toward a static vertical component on a face of the one or more processing devices in a manner that maintains a registration integrity of the set 240.

Figure 5:
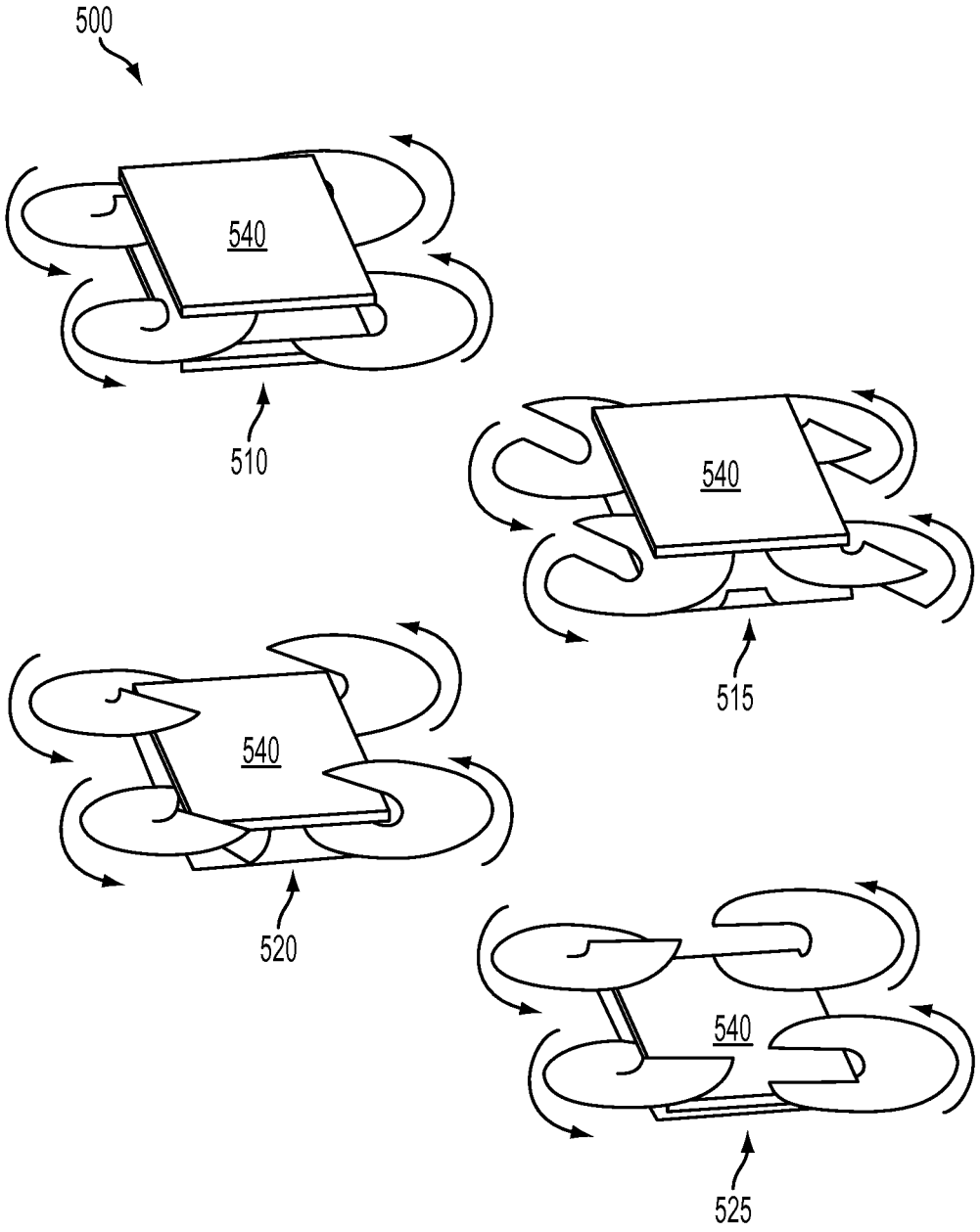
FIG. 5 illustrates a simple schematic diagram of an overview of an exemplary functioning of an auger-based vertical compiler system in the disclosed manner.

FIG. 5 illustrates a simple schematic diagram of an overview 500 of an exemplary functioning of an auger-based vertical compiler system is four exemplary stages 510-525 for moving a set 540 vertically downward in the compiler system. The depictions in FIG. 5 are intended to provide context by which to aid in a general visualization of the disclosed structures and methods.

The above-described well-controlled vertical motion of the auger-type vertical compiler system may substantially reduce, and potentially eliminate, variations in in-set and set-to-set registration in the various individually-segmented stages of operation of the compiler. This process may replace the methods and structures for automated cycling of supports, arms and/or shutters in conventional mechanical compilers.

In high speed image receiving media substrate handling operations, the disclosed systems and methods may generally shorten the distance covered by each step or process in vertical movement of individual sets. By segregating the operations, as discussed above, an achievable throughput of print jobs, and a service life of the structurally-movable components of the auger-based vertical compiler system, may be increased. By breaking up the operations into smaller pieces, a timing between collection and collation of sets may be reduced and each operation may be performed in a manner that achieves the individual objectives, e.g., tamping, holding, stapling and/or ejecting, in a slower, more-controlled manner than trying to do them all at once. In this manner, the overarching (print job) process may be sped up while slowing down each individual operation in the process. By moving the sets more slowly through the overall process, less disturbance and registration issues may be introduced to the sets.

An introduction of augers may eliminate a need for many of the complicated mechanisms required to complete set creation/registration and stack creation/registration operations. The augers may, for example, eliminate a need for one or more of a leading edge clamp, a trailing edge clamp, shutters and temporary compilers, and may slow down operations of other related mechanisms such as ejectors and edge tampers.

Objective in the disclosed auger design may include substantially eliminating random, uncontrolled dropping of both individual sheets and sets. Dropping the sheets and sets is known to generically lead to poor registration and set-to-set distinction, particularly in instances in which little time is allocated for settling. Releasing the sheets to free fall from one point to another induces variability that may be effectively and advantageously addressed by the disclosed schemes, structures and techniques. In other words, by eliminating the drop function from the design, set registration may be substantially improved. In addition, as process speeds increase in conventional systems, the drop speed will not increase because the drop speed is based on the gravitational constant. Timing, already an issue, becomes ever more critical and possibly unattainable. Implementation of the disclosed schemes may effectively address the restrictions on the throughput.

The disclosed systems substantially preclude the variability incumbent in the introduction of air as sets are created and dropped. No boundary layer of air, or air bearing, may be created that would otherwise promote mis-registration and/or substrate "fluff" that may require a settling time prior to the system acting on the set. In addition to the registration issues, the "fluff" can also affect tamping, stacking, and stapling because the set height and stiffness are affected. The auger motion that moves each set through the process steps will allow more time for this sheet settling to the extent that there is any, even-limited, "fluff."

Figure 6:
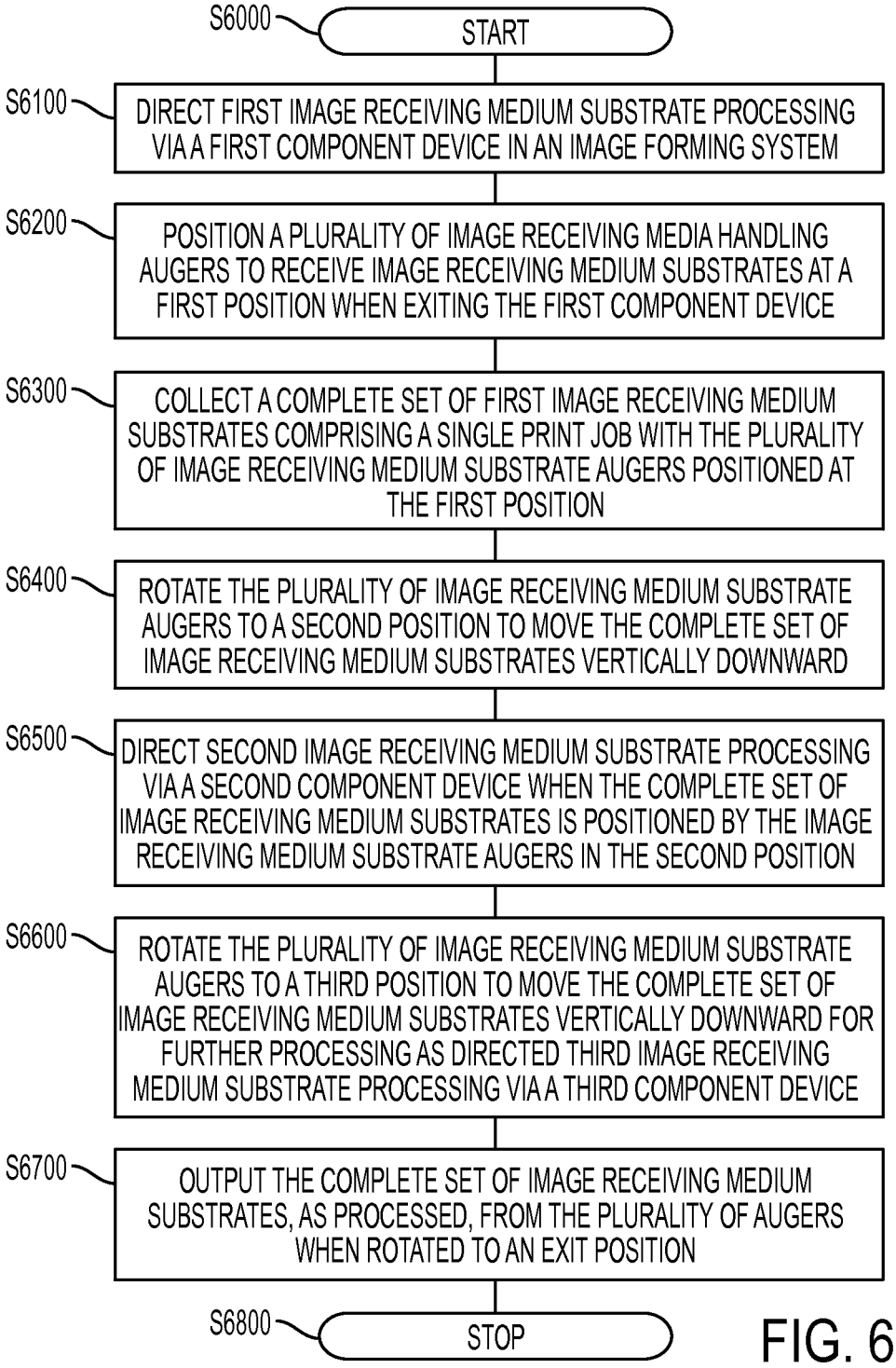
FIG. 6 illustrates a flowchart of an exemplary method for implementing vertical transport of individual image receiving media substrate sheets, sets of image receiving media substrate sheets and stacks of image receiving media substrate sets in an image forming system using an auger-based vertical compiler system according to this disclosure.

The disclosed embodiments may include a method for implementing an auger-based transport system comprising a plurality of mechanical augers for vertical transport of image receiving media substrates at least in post-processing systems of image forming devices and advanced image forming systems. FIG. 6 illustrates a flowchart of such an exemplary method. As shown in FIG. 6, operation of the method commences at Step S6000 and proceeds to Step S6100.

In Step S6100, a first image receiving media substrate process may be undertaken using a first component device in an image forming system. The first image receiving media substrate process may be any of substrate receiving, preprocessing, marking, finishing or post processing in the image forming system. Operation of the method proceeds to Step S6200.

In Step S6200, a plurality of image receiving media substrate handling augers may be positioned downstream of the first component device in a process direction to receive image receiving media substrates exiting the first component device. The plurality of augers may be positioned at a first position according to positioning controlled by auger motors and an auger controller in order that the image receiving may be collected on top of the augers while the augers are maintained in a static first position. Operation of the method proceeds to Step S6300.

In Step S6300, individual image receiving media substrates exiting the first component device may be collected as a set on top of the plurality of augers according to information received, for example, by the auger controller. Operation of the method proceeds to Step S6400.

In Step S6400, a signal may be received via the auger controller to cause the auger motor(s) to rotate the augers to a second position in which the collected set of image receiving media substrates is translated vertically down the compiler a specified distance in order that the augers may be stopped and held in a second position as image forming operations continue in the image forming system and another set of image receiving media substrates may be collected on top of the augers. Operation of the method proceeds to Step S6500.

In Step S6500, a set that has been moved vertically lower in the compiler with the augers now halted in a second position may be presented partially or completely to a second device for second image receiving media set processing that may be one or another of image receiving media substrate processing that is different from the first image receiving media processing in the image forming system. Operation of the method proceeds to Step S6600.

In Step S6600, rotation of the augers may be continued as multiple sets may be engaged by the augers implementing controlled vertical movement of the sets toward an exit, or via potential additional processing as the sets are translated vertically lower in the compilers. Operation of the method proceeds to Step S6700.

In Step S6700, one or more complete sets of finished and processed image receiving media substrates may be output in order as the augers are rotated to an exit position. Operation of the method proceeds to Step S6800, where operation of the method ceases.

It should be recognized that, in complex image forming systems, multiple media transport paths may be established. Auger-based vertical compilers may be positioned, as appropriate, downstream of individual image receiving media substrate processing devices in an image forming system to support image receiving media transport among one of multiple paths switching, as appropriate, between a plurality of media driving modes according to each obtained image forming operation.

The above-described exemplary systems and methods reference certain conventional components to provide a brief, general description of suitable document processing and post-processing means by which to carry out the disclosed image receiving media transport techniques in support of obtained image forming operations in the image forming system. Those skilled in the art will appreciate that other embodiments of the disclosed subject matter may be practiced with many types and configurations of individual devices and combinations of devices particularly common to image forming and post-processing of image formed products in image forming devices of varying complexity. No limitation to the variety or configuration of individual component devices included in image forming systems of varying complexity is to be inferred from the above description.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 6, and the accompanying description, except where a particular method step is a necessary precondition to execution of any other method step. Individual method steps may be carried out in sequence or in parallel in simultaneous or near simultaneous timing, as appropriate.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

I claim:

1. A method for handling image receiving media substrates in an image forming system, comprising:

providing a plurality of processed image receiving media substrates at an output of a first image receiving media substrate processing device in an image forming system;

providing a vertical compiler in a vicinity of the output of the first image receiving media substrate processing device as a transport mechanism for one of individual substrates or collected sets of image receiving media substrates exiting the first image receiving media substrate processing device, the vertical compiler comprising:

a plurality of augers as the vertical transport mechanisms in the vertical compiler;

at least one auger motor for driving the augers in a coordinated manner about respective vertical auger shafts for the plurality of augers; and an auger motor controller that controls operation of the at least one auger motor;

collecting a set of image receiving media substrates in a first position on a top of the plurality of augers; and operating the plurality of augers to move the collected set of image receiving media substrates downward in the vertical compiler to a second position;

receiving, with the auger motor controller, signals regarding image processing in the first image receiving media substrate processing device indicating collection of a first full set of image receiving media substrates in the first position on the plurality of augers;

causing, with the auger motor controller, the at least one auger motor to operate to move the first full set of image receiving media substrates lower in the vertical compiler to the second position leaving the top of the augers open to receive a second full set of image receiving media substrates in the first position;

executing second processing on the first full set of image receiving media substrates with a second image receiving media substrate processing device when the first full set of image receiving media substrates is positioned at the second position;

receiving, with the auger motor controller, additional signals regarding image processing in the second image receiving media substrate processing device indicating completion of the second processing on the first full set of image receiving media substrates in the second position; and causing, with the auger motor controller, the at least one auger motor to operate to move the first full set and the second full set of image receiving media substrates lower in the vertical compiler to respective third and second positions leaving the top of the augers open to receive a third full set of image receiving media substrates in the first position.

2. The method of claim 1, the third position being an exit position from the vertical compiler, the method further comprising depositing the first full set of image receiving media substrates on a stack of other sets of image receiving media substrates in a vicinity of the exit position from the vertical compiler.

3. The method of claim 1, the plurality of augers comprising one of (1) an opposing single pair of augers or (2) multiple pairs of opposing augers.

4. The method of claim 1, the plurality of augers being rotated by the at least one auger motor in opposing counter-rotating directions.

5. The method of claim 4, the opposing counter-rotating directions causing the sets of substrates to be moved longitudinally toward structures associated with at least one of the first image receiving media substrate processing device and a second image receiving media substrate processing device to facilitate maintaining a vertical registration of the individual image receiving media substrates in the stack.

6. A system for processing image receiving media substrates, comprising a first image receiving media substrate processing device for first processing image receiving media substrates;

a vertical compiler in a vicinity of an output of the first image receiving media substrate processing device as a transport mechanism for collected sets of image receiving media substrates exiting the first image receiving media substrate processing device, the vertical compiler comprising:

a plurality of augers as the vertical transport mechanisms in the vertical compiler;

at least one auger motor for driving the augers in a coordinated manner about respective vertical auger shafts for the plurality of augers; and an auger motor controller that controls operation of the at least one auger motor;

a collection area for collecting processed sets of image receiving media substrates at an exit of the vertical compiler, the first image receiving media substrate processing device generating signals for the auger motor controller indicating collection of a first full set of image receiving media substrates in a first position on top of the plurality of augers, and the auger motor controller causing the at least one auger motor to operate to move the first full set of image receiving media substrates lower in the vertical compiler to a second position leaving the first position on the top of the augers open to receive a second full set of image receiving media substrates;

at least a second image receiving media substrate processing device positioned lower than the first image receiving media substrate processing device to execute second processing on the first full set of image receiving media substrates when positioned at the second position, the second image receiving media substrate processing device generating additional signals regarding image processing in the second image receiving media substrate processing device indicating completion of the second processing on the first full set of image receiving media substrates in the second position, and the auger motor controller causing the at least one auger motor to operate to move the first full set and the second full set of image receiving media substrates lower in the vertical compiler to respective third and second positions leaving the top of the augers open to receive a third full set of image receiving media substrates in the first position.

7. The system of claim 6, the third position substantially corresponding with the exit of the vertical compiler, the plurality of augers placing the sets of image receiving media substrates in the collection area.

* * * * *